United States Patent [19]

Kikuchi et al.

[11] Patent Number: 4,657,417

[45] Date of Patent: Apr. 14, 1987

[54] THERMAL PRINTER

[75] Inventors: Noboru Kikuchi, Iwate; Tadashi Nakamura, Morioka; Takahito Maruyama, Tamayama, all of Japan

[73] Assignee: Alps Electric Co., Ltd., Japan

[21] Appl. No.: 716,179

[22] Filed: Mar. 26, 1985

[30] Foreign Application Priority Data

Mar. 29, 1984 [JP] Japan ..... 59-44149[U]

[51] Int. Cl.[4] ..... B41J 3/20; B41J 23/00

[52] U.S. Cl. ..... 400/185; 400/120

[58] Field of Search ..... 400/120, 59, 185, 187, 400/320, 216.1, 57; 346/76 PH

[56] References Cited

U.S. PATENT DOCUMENTS

| | | | |
|---|---|---|---|
| 1,918,302 | 7/1933 | Trego | 400/691 |
| 2,156,614 | 5/1939 | Yaeger | 400/57 X |
| 3,739,897 | 6/1973 | Pateuk et al. | 400/320 X |
| 3,855,448 | 12/1974 | Hanagata et al. | 346/76 PH X |
| 4,030,558 | 6/1977 | Hanagata et al. | 400/185 X |

FOREIGN PATENT DOCUMENTS

| | | | |
|---|---|---|---|
| 37436 | 4/1978 | Japan | 400/120 |
| 148677 | 9/1982 | Japan | 400/120 |
| 2140746 | 12/1984 | United Kingdom | 400/185 |

*Primary Examiner*—Charles A. Pearson

*Attorney, Agent, or Firm*—Guy W. Shoup

[57] ABSTRACT

Disclosed is a thermal printer which comprises a thermal head mounted on a carriage and movable relative to a platen having recording paper wound partially therearound, and a carriage guide plate carrying the carriage, and pivoted so as to separate the thermal head from the platen. A cam mechanism is provided for pivoting the carriage guide plate, and a cam operation mechanism driven by the motor is provided for operating the cam mechanism.

1 Claim, 9 Drawing Figures

THERMAL PRINTER

BACKGROUND OF THE INVENTION

1. Field of the Invention

The present invention relates to a thermal printer.

2. Description of Prior Art

Conventionally, there has been proposed a thermal printer in which a print tape provided with a thermally fusible material is disposed between a recording paper and a thermal head so that a plurality of heat generation elements provided in the thermal head could be selectively energized to generate heat in accordance with movement of the thermal head to soften the thermally fusible material and thereby transfer the thermally fusible material onto the recording paper. Such thermal printers have an advantage in that less noises are generated in printing compared with other types of printers. In the thermal head, however, an electromagnetic solenoid is typically needed for separating the thermal head from a platen upon returning a carriage on which the thermal head was mounted and, therefore, there is a disadvantage that noises were generated upon returning of the carriage.

SUMMARY OF THE INVENTION

An object of the present invention is, therefore, to eliminate the disadvantage of the prior art thermal head.

Another object of the present invention is to provide a thermal printer which is arranged so that minimal noises are generated upon returning of the carriage with a simple arrangement.

In order to attain the objects, the thermal printer according to the present invention comprises a thermal head adjacent a platen adapted to receive the recording paper. A thermal head carriage is driven by a motor, and mounted to a movable guide plate. The carriage guide plate can be pivoted by a cam mechanism driven by the motor for pivoting the carriage guide plate to thereby separate the thermal head from the platen during return of the carriage.

The above objects, features and advantages of the present invention will be apparent when read the following description in conjunction with the accompanying drawings.

BRIEF DESCRIPTION OF THE DRAWINGS

Drawings illustrate an embodiment according to the present invention, in which:

FIG. 2(*b*) is a sectional view of a carriage portion of the same;

FIG. 6(*b*) is a sectional view along A—A line in FIG. 6(*a*).

PREFERRED EMBODIMENT OF THE INVENTION

Figure 1:
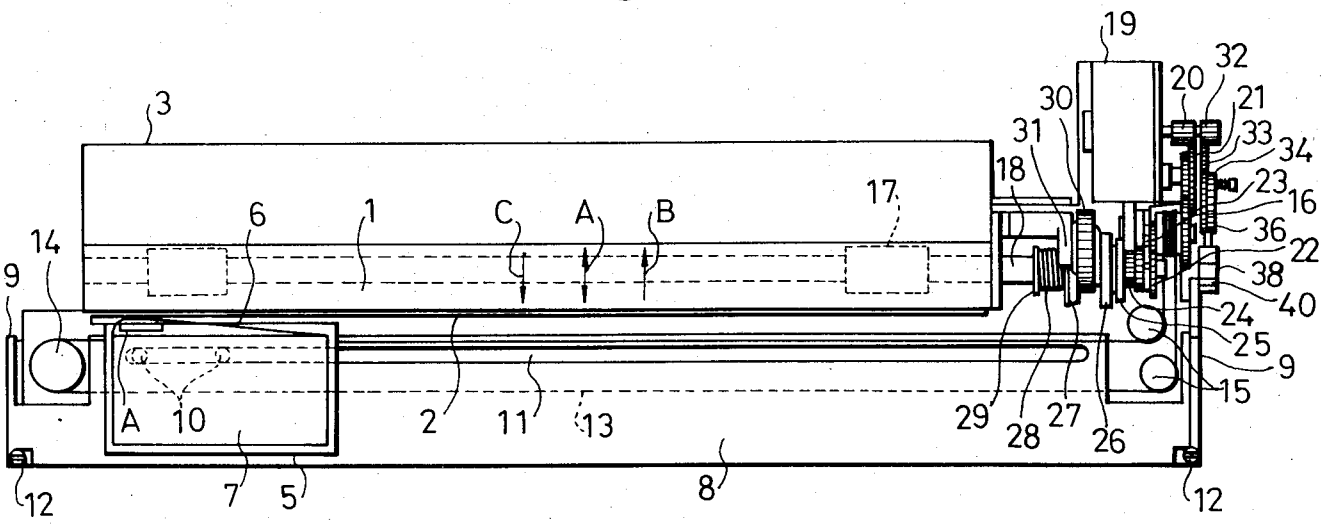
FIG. 1 is a plan view showing the arrangement of the present invention.

Referring to the drawings, an embodiment of the present invention will be described hereunder.

A thermal printer according to the present invention includes a platen 1 for receiving recording paper wound partially therearound, and a strip 2 of rubber or the like is positioned on the front of the platen 1, that is, at a printing position along the platen 1. A paper guide 3 is provided for guiding recording paper around the platen 1, and a thermal head 4 having a plurality of heat generating elements disposed in opposition to the rubber strip 2 is mounted on a carriage 5. A print tape 6 having a thermally fusible material to be transferred onto the recording paper is contained within a tape cassette 7 mounted removably to the carriage 5.

Figure 2A:
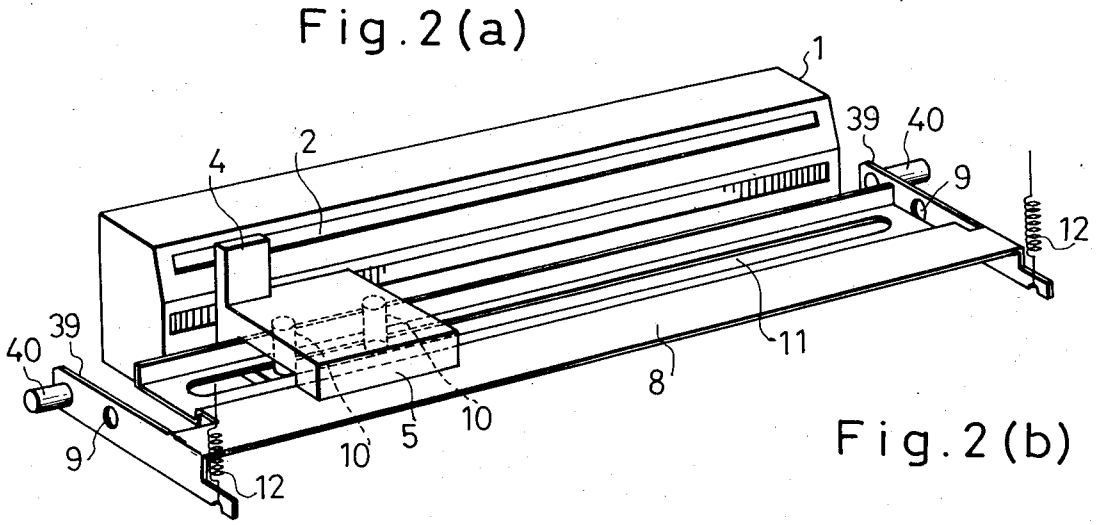
FIG. 2(*a*) is a perspective view of a substantial portion of the same.
Figure 2B:
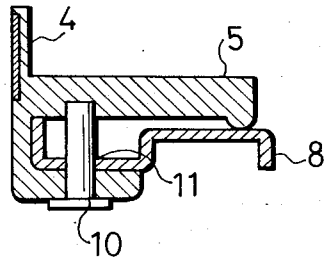

The carriage 5 is movably mounted on a carriage guide plate 8 rotatable about a support portion 9 as shown in FIG. 2(*a*). The carriage guide plate 8 is provided with a groove 11 for guiding carriage guide shafts 10 fixed to the carriage 5, as shown in FIGS. 2(*a*) and (*b*). The carriage guide plate 8, the carriage guide shafts 10 and the groove 11 constitute a carriage guide mechanism for guiding the carriage 5 along the front surface of the platen 1.

A pair of pressing springs 12 are provided on respective ends of the carriage guide plate 8 for urging the guide plate 8 against the carriage 5 to bias the thermal head 4 toward the rubber strip 2.

As shown in FIG. 1, a wire 13 has its opposite ends connected respectively with the opposite ends of the carriage 5, and the wire 13 is directed around pulleys 14 and 15 disposed on the carriage guide plate 8. The wire 13 also extends around a drive pulley 16 which, for example, may be provided with a pair of gears at its opposite sides. The wire 13, the pulleys 14 and 15, and the drive pulley 16 constitute a carriage displacing means for displacing the carriage 5 along the platen 1.

There are further provided a paper feed roller 17 for holding the recording paper in position against the platen, and a paper feed shaft 18 supports the paper feed roller 17. The paper feed roller 17 and the paper feed shaft 18 constitute a recording paper feed means for feeding a recording paper in the directions of the double-headed arrow A in FIG. 1.

The mechanisms for feeding the paper, moving the carriage along the platen, and moving the thermal head toward and away from the platen are operated together through a single drive motor, and a preferred embodiment is described below. The mechanisms for feeding the paper and moving the carriage need not be restricted to the described embodiment, and they are therefore described schematically. Conventional paper feed and carriage drive mechanisms may be used with the improvement of the invention described herein.

In order to rotate the paper feed roller 17 to feed the recording paper, as well as to reciprocate the carriage 5 thereacross, a stepping motor 19 has an output shaft connected to a motor gear 20, and an idle gear 21 is engaged by both the motor gear 20 and a gear at one of the opposite sides of the drive pulley 16. A first intermittent gear 22 engages the gear of the other side of the drive pulley 16, and a second intermittent gear 23 engages the first intermittent gear 22 while a paper feed gear 24 engages the second intermittent gear 23. A movable contact mounting member 25 and a ratchet 26 engaged by the paper feed gear 24 are also provided, and another ratchet 27 which is engageable/disengageable with the ratchet 26 is urged by the ratchet spring 28 in the direction of engaging with the ratchet 26. A washer 29 restricts one end of the ratchet spring 28, and a manual knob 30 is provided for displacing the ratchet 27 away from the ratchet 26 and has a circumferentially formed gear which is engageable with a gear formed on the ratchet 27. A lever 31 is provided for rotatably supporting the manual knob 30.

A motor gear 20, the idle gear 21, the drive pulley 16, the first intermittent gear 22, the second intermittent gear 23 and the paper feed gear 24 form a gear portion which is able to interlink the carriage displacing means and the recording paper feed means, that is, a gear portion which moves the carriage 5 back and forth and feeds the recording paper by a predetermined amount in the direction of an arrow B in FIG. 1 in response to one reciprocation of the carriage 5.

The ratchets 26 and 27 and the manual knob 30 form a manual paper feed means which is able to feed the recording paper reversely, that is, in the direction of an arrow C in FIG. 1.

Figure 3A:
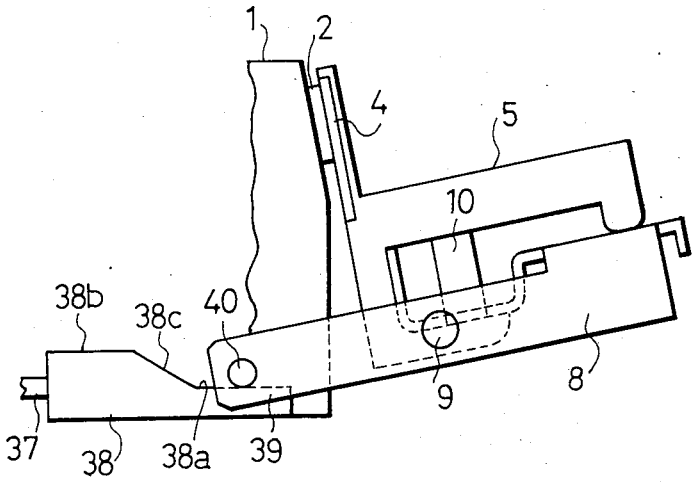
FIGS. 3(*a*) and (*b*) are side views showing variations in positional relation between the platen and the carriage.
Figure 3B:
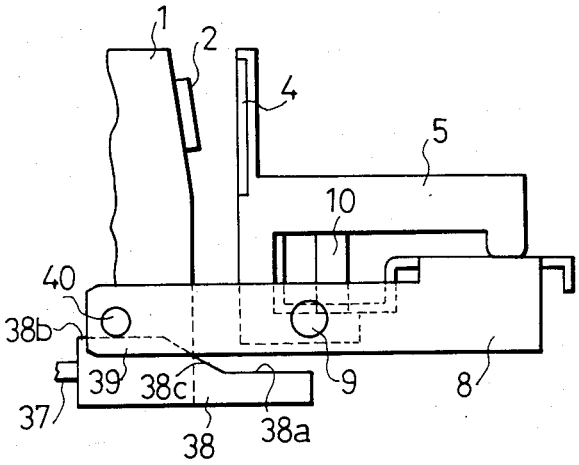
Figure 4:
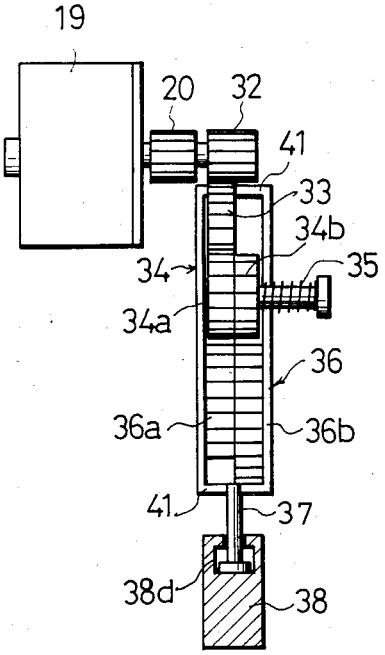
FIG. 4 is an upper plan view showing the relation between the cam and the cam operation means.
Figure 5:
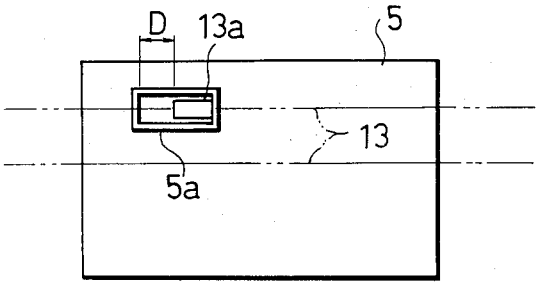
FIG. 5 is an enlarged fragmentary showing the relation between the wire and the carriage.

As shown in FIGS. 1 and 4, a drive gear 32 is provided on a shaft extending from the motor gear 20 of the motor 19, and the drive gear 32 engages with a connection gear 34 through an idler 33. The connection gear 34 is constituted by a fixed gear 34*a* driven by the drive gear 32 and an abutment gear 34*b* provided adjacent to and caused to be in frictional contact with the fixed gear 34*a* through a spring 35, the connection gear 34 engaging with a rack 36 arranged in opposition thereto. The rack 36 is constituted by two rows of toothed portions, one rack having gear portion 36*a* which meshes with the fixed gear 34*a* and which has no toothed portions at each of its ends, and the other being a gear portion 36*b* which meshes with the abutment gear 34*b*. The drive gear 32, the connection gear 34, and the rack unit 36, and the like, constitute a cam operation means. A T-shaped protrusion 37 is provided on the rack 36 and projects therefrom into a space portion 38*d* provided in a cam 38, as can be seen from FIGS. 3(*a*) and 3(*b*), having a lower portion 38*a*, an upper portion 38*b*, and a ramp portion 38*c* formed between the lower and upper portions 38*a* and 38*b*, such that the protrusion 37 is capable of reciprocating in the space portion 38*d*.

The cam 38 is caused to abut on a shaft portion 40 of a receiving portion 39 extended from the support portion 9 of the carriage guide plate 8 as shown in FIGS. 2 and 3.

Thus, when the receiving portion 39 is located at the lower position 38*a* of the cam 38, as shown in FIG. 3(*a*), the platen 1 is in contact with the head 4, and when the receiving portion 39 is located at the upper position 38*b* of the cam 38, the platen 1 and the thermal head 4 are spaced apart from each other against the bias of the pressing spring 12 so that the carriage 5 can be returned by the wire in this state.

The drive gear 32 of the cam operation means is always in a state of being driven by the motor 19, while the stroke of the cam 38 or the rack 36 is limited to be within a predetermined range by a stopper 41. Accordingly, the rack 36 is arranged to have the two rows of gear portions, that is the partly-tooth-lacked gear portion 36*a* and the entirely-toothed gear portion 36*b*. The fixed gear 34*a* of the connection gear 34 is positioned to mesh with the partly-tooth-lacked gear portion 36*a* only at its central portions so that fixed gear 34*a* does not mesh with the rack 36 when the connection gear 34 is located at either end of the rack 36 in order to prevent the drive force of the motor 19 from being directly applied onto the rack 36 or the cam 38.

The gear 34*b* is rotated by the frictional force created by means of being biased against gear 34*a* by the spring 35. The two toothed portions 36*a*, 36*b* of the rack 36 are driven together. When the gear 34*a* is driven so as to be at either non-toothed end of the portion 36*a*, the frictional force between gears 34*a* and 34*b* is smaller than the force stopping the rack, and the gear 34*b* is thus held non-rotated and the rack 36 is not driven. When the motor 19 is driven in one direction, the rack is retracted and the thermal head is moved against the platen as shown in FIG. 3(*a*). When the motor is reversed, the rack is extended and the thermal head is moved by the ramp 38*c* acting on shaft portion 40 to the position against the platen as shown in FIG. 3(*b*).

Moreover, in order to eliminate influence onto various members due to a sudden change caused by forward/reverse rotation of the motor 19, the protrusion 37 of the rack 36 is partly located in the space portion 38*d* formed in the cam 38 and a clearance is provided between the rack 36 and the cam 38. Similarly to this, with respect to the engagement relation between the carriage 5 and the wire 13, a space D is formed to provide a clearance of movement between an expanded portion 13*a* formed in the wire 13 and a frame 5*a* provided in the carriage 5, so that the displacement of the carriage 5 is not performed before the platen 1 and the thermal head 4 have been fully moved into any state.

Figure 6:
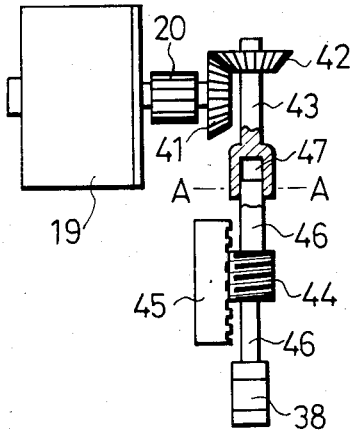
FIG. 6(*a*) is an upper plan view showing another embodiment of the cam operation means.
Figure 6:
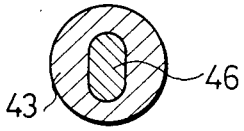

Another embodiment of the cam operation means is shown in FIGS. 6(*a*) and 6(*b*).

That is, a bevel gear 41 is provided on a motor 19, a shaft 43 is secured to a bevel gear 42 which meshes with the bevel gear 41, a pinion 44 is secured to a shaft 46 which engages with the shaft 43, and this pinion 44 is made to engage with a fixed rack 45. The shaft 46 of the pinion 44 is connected to the cam 38 in a similar manner to the first-mentioned embodiment. The engagement portion between the shafts 43 and 46 is arranged such that a space portion 47 having a non-circular cross-section is formed in the shaft 43 so that the shaft 46 is loosely inserted into the space portion 47, thereby allowing the engagement portion to rotate as well as making the shaft 46 movable with respect to the shaft 43.

Thus, the revolution of the motor 19 is transmitted to the shaft 43 by means of the bevel gears 41 and 42, so that the shaft 46 of the pinion 44 is rotated by the revolution of the shaft 43. Since the rack 45 is fixed, the pinion 44 moves together with the shaft 46 along the rack 45. Thus, the movement of the pinion 44 causes the cam 38 to operate in the same manner as in the previous embodiment.

The present invention provides such an arrangement as described above in which the cam operation means and the cam means are actuated by the carriage driving motor to effect contacting/discontacting operation between the thermal head and the platen, whereby it can provide a thermal printer which is simple in structure and in which the thermal printer head generates less noises in comparison with the conventional ones.

What is claimed is:

1. In a printer of the type having a platen for supporting a recording paper thereon, a print head mounted on a carriage in opposing relation to the platen, the carriage being mounted on a carriage guide and being movable reciprocatingly along the platen, carriage moving means for moving the carriage along the platen, and paper feeding means for feeding the recording paper incrementally with respect to the platen, the improvement comprising:

the carriage guide means being pivotable along an axis thereof for moving the print head away from the platen in one direction and against the platen in the other direction, and having a shaft portion extending therefrom;

cam means movable linearly back and forth and having a ramp-shaped portion engaged with the shaft portion of the carriage guide means to pivot the print head in each direction;

cam operation means for linearly moving the cam means; and a single drive motor for driving the paper feeding means, the carriage moving means, and the cam operation means, wherein the cam operation means comprises a drive gear driven by the motor, a connection gear including a fixed gear engaged with the drive gear and an abutment gear urged in frictional contact with the fixed gear by means of a spring, and a rack including two rows of toothed portions, one toothed portion being meshed with the fixed gear and having non-toothed idler sections at each end thereof, and the other toothed portion being meshed with the abutment gear, the rack being connected to the cam means and linearly movable in either direction by rotation of the drive gear.

* * * * *